US009682265B2

(12) United States Patent
Shutts

(10) Patent No.: US 9,682,265 B2
(45) Date of Patent: Jun. 20, 2017

(54) APPARATUS FOR USE IN EXERCISE, REHABILITATION AND OTHER MOVEMENTS IN WATER

(71) Applicant: Anthony Lee Shutts, Powell, OH (US)

(72) Inventor: Anthony Lee Shutts, Powell, OH (US)

(73) Assignee: ISO-AQUATICS, LLC, Powell, OH (US)

( * ) Notice: Subject to any disclaimer, the term of this patent is extended or adjusted under 35 U.S.C. 154(b) by 235 days.

(21) Appl. No.: 14/266,881

(22) Filed: May 1, 2014

(65) Prior Publication Data

US 2014/0329647 A1 Nov. 6, 2014

Related U.S. Application Data

(60) Provisional application No. 61/818,433, filed on May 1, 2013.

(51) Int. Cl.

| | |
|---|---|
| ***A63B 21/008*** | (2006.01) |
| ***A63B 21/00*** | (2006.01) |
| ***A63B 26/00*** | (2006.01) |
| ***A63B 21/068*** | (2006.01) |
| ***A63B 23/12*** | (2006.01) |

(Continued)

(52) U.S. Cl.

CPC ..... *A63B 21/00047* (2013.01); *A63B 21/068* (2013.01); *A63B 23/1218* (2013.01); *A63B 7/00* (2013.01); *A63B 17/04* (2013.01); *A63B 21/0084* (2013.01); *A63B 21/00181* (2013.01); *A63B 21/0442* (2013.01); *A63B 21/0552* (2013.01); *A63B 23/0216* (2013.01);

(Continued)

(58) Field of Classification Search

CPC ..... A63B 21/00047; A63B 21/068; A63B 21/0803; A63B 23/1218; A63B 23/1227; A63B 69/12; A63B 69/14; A63B 7/00; A63B 35/00; A63B 23/12; A63B 23/1209; A63B 2208/03; A63B 31/00; A63B 33/00; B63B 27/146

See application file for complete search history.

(56) References Cited

U.S. PATENT DOCUMENTS 649,900 A * 5/1900 Brennan ..... A47C 21/024 5/505.1

3,102,280 A 9/1963 Williams (Continued)

*Primary Examiner* — Loan H Thanh
*Assistant Examiner* — Nyca T Nguyen
(74) *Attorney, Agent, or Firm* — Jason H. Foster; Kremblas & Foster

(57) ABSTRACT

An exercise device for use when a person is in a pool or other water body. A central boom extends from attachment to a sidewalk around the pool, and extends to a wishbone member that forms a furcated member mounted to the central boom. The wishbone has lateral members that are parallel and spaced with hand-grippable handles at the ends farthest from the central boom, and disposed over the water. A user can grasp the handles and perform numerous exercise movements while buoyed, at least partially, by the water. A lower support member is mounted to the central boom beneath the wishbone, and a handle is mounted to the central boom between the wishbone and the lower support member. The user can rest his shoulders on the lower support member and hold the handle mounted to the boom, and perform abdominal exercises. Many other movements are possible.

14 Claims, 4 Drawing Sheets

(51) Int. Cl.

| | |
|---|---|
| *A63B 71/02* | (2006.01) |
| *A63B 7/00* | (2006.01) |
| *A63B 17/04* | (2006.01) |
| *A63B 21/04* | (2006.01) |
| *A63B 21/055* | (2006.01) |
| *A63B 23/02* | (2006.01) |

(52) U.S. Cl.
CPC ..... *A63B 71/028* (2013.01); *A63B 2208/03* (2013.01); *A63B 2225/60* (2013.01)

(56) References Cited

U.S. PATENT DOCUMENTS

| | | | | |
|---|---|---|---|---|
| 3,973,646 | A * | 8/1976 | Martinez | E06C 9/02 182/106 |
| 4,149,712 | A | 4/1979 | Murphy | |
| 4,640,268 | A * | 2/1987 | Roberts | A63B 21/06 482/139 |
| 4,768,774 | A | 9/1988 | Beasley | |
| 4,784,385 | A | 11/1988 | D'Angelo | |
| 4,822,031 | A | 4/1989 | Olschewski | |
| 4,838,545 | A | 6/1989 | Wilson | |
| 4,875,673 | A | 10/1989 | Erickson | |
| 4,941,659 | A | 7/1990 | Silvestri | |
| 5,033,735 | A | 7/1991 | Erickson | |
| 5,050,863 | A | 9/1991 | Yacoboski | |
| 5,149,314 | A | 9/1992 | Ciolino et al. | |
| 5,234,391 | A | 8/1993 | Shasek et al. | |
| 5,306,217 | A | 4/1994 | Bracone | |
| 5,333,322 | A | 8/1994 | Weir | |
| 5,354,253 | A | 10/1994 | Awbrey et al. | |
| 5,403,253 | A * | 4/1995 | Gaylord | A63B 21/068 482/140 |
| 5,743,283 | A | 4/1998 | Horvath | |
| 5,813,957 | A | 9/1998 | Rossiter | |
| 6,033,351 | A | 3/2000 | Sizemore, III et al. | |
| 6,179,759 | B1 | 1/2001 | Tellone | |
| 6,217,483 | B1 * | 4/2001 | Kallassy | A63B 21/068 482/38 |
| 6,474,244 | B1 | 11/2002 | Karpinski | |
| D524,451 | S | 7/2006 | Morris | |
| 7,147,591 | B2 * | 12/2006 | McAvoy | A63B 1/00 482/148 |
| 7,344,482 | B2 | 3/2008 | Checketts | |
| D578,582 | S * | 10/2008 | Gomez | D21/686 |
| 8,246,524 | B2 * | 8/2012 | Castillo | A63B 21/023 482/101 |
| D667,514 | S | 9/2012 | Pribelyi | |
| 2006/0019799 | A1 | 1/2006 | Checketts | |
| 2012/0264574 | A1 * | 10/2012 | Chang | A63B 69/12 482/55 |
| 2014/0274607 | A1 * | 9/2014 | Kaye | A63B 21/0557 482/130 |

* cited by examiner

APPARATUS FOR USE IN EXERCISE, REHABILITATION AND OTHER MOVEMENTS IN WATER

CROSS-REFERENCES TO RELATED APPLICATIONS

This application claims the benefit of U.S. Provisional Application No. 61/818,433 filed May 1, 2013. This prior application is hereby incorporated by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT.

(Not Applicable)

REFERENCE TO AN APPENDIX (Not Applicable)

BACKGROUND OF THE INVENTION

The invention relates broadly to exercise and rehabilitation devices and methods, and more particularly to exercise and rehabilitation devices and methods used by humans while in water.

It is well known that moderate exercise is beneficial to human health, due to increased heart rate, cycles of muscle contraction and relaxation, and stretching of tissues. Many exercises are difficult for people who have been injured, disabled or have a physical limitation, and it is known that exercising in water can reduce such problems. The buoyancy that water provides can substantially reduce the impact to the body of running and movements that are typically performed in air. The significantly greater resistance to movement provided by water than air can also provide benefits to the movements of those with difficulty in exercise, particularly given the resistance in all directions combined with the quantity of resistance.

Human movement in water can be difficult due to the instability that arises from buoyancy and increased resistance to movement compared to movement in air. This difficulty normally encourages the use of devices or apparatuses that stabilize people who are attempting to perform movements in water. However, such devices tend to create new problems due to instability, insufficient range of movement, poor design, and cost. The need exists for a device that allows humans to move in water in a variety of ways in order to tailor the types of movements to the needs of the person and his or her abilities and disabilities.

BRIEF SUMMARY OF THE INVENTION

An exercise apparatus is disclosed in combination with a container having a sidewall retaining water. The container can be a pool, hot tub or any equivalent body that humans can move around in for exercise. The combination comprises a central boom with a lower boom end rigidly mounted adjacent the sidewall of the water container, for example in a sidewalk, walkway or deck that abuts the pool's sidewall. The central boom can insert into a cylindrical pocket or other cavity formed in the sidewalk, and extends upwardly to an upper boom end that is closer to being above the water than the lower boom end. That is, the central boom extends with a vertical component away from the sidewalk into which it is attached, and has a horizontal component extending toward the water. The boom might not extend over the water in all circumstances, and the upper end of the boom might be farther from the water than the lower end if the vertical component is larger than the horizontal component.

A furcated support member, such as a U-shaped wishbone, is rigidly mounted to the central boom at the upper boom end. The furcated support member is defined by first and second lateral support members that are preferably substantially parallel to one another and spaced to form a gap. The lateral support members extend from first support member ends, which are mounted to the upper boom end, to second support member ends spaced from the central boom and disposed above the water. First and second hand-grippable handles are mounted to the first and second lateral support members near the second support member ends and are disposed above the water. The handles are preferably rectangular, but are possibly triangular or some other polygon shape that presents multiple angled structures that can be grasped by a human user.

In a preferred embodiment, a lower support member extends from the central boom. The lower support member has first and second lateral support members disposed below the furcated support member and spaced therefrom. The lower support member preferably comprises a sub-boom mounted to the central boom. The lower support member's first and second lateral support members extend from first support member ends, which are mounted to an end of the sub-boom farthest from the central boom, to second support member ends spaced from the sub-boom. The mounting structure between the first and second support members of the lower support member and the sub-boom preferably permits pivoting of the lateral support members of the lower support member relative to the sub-boom. Thus, the first and second lateral support members can be pivoted away from beneath the furcated member so that the lower support member is not in the way of a user using the furcated member.

A handle is preferably mounted to the central boom between the furcated support member and the lower support member to provide stability to the user. A shield is preferably disposed above the furcated member and mounted to at least the boom in order to protect the apparatus from damage caused by the sun.

The invention allows the user to perform numerous exercises while in the water, thereby taking advantage of the safety, comfort and buoyancy of the water. If the user falls from the apparatus, which is unlikely, he or she merely falls into water. Thus, the apparatus is very safe to use. Furthermore, because the user is in water, overheating during exercise is unlikely. Still further, the buoyancy of the water permits the user to engage in exercises that are either not possible apart from the water, and/or that require very expensive fitness equipment to perform apart from water. For example, the user can be suspended substantially parallel to the surface of the water from the wishbone or lower support member, or both, using straps or other accessories, while placing her feet against the side of the pool. A moderate resistance band made of an elastomeric material can be tied to the base of the central boom and grasped by the hands. The user can then bend her legs to relax the band and then straighten her legs to stretch the band, thereby gaining the use of her leg muscles against a resistance that is far smaller than that due to gravity (or more, if desired).

The apparatus is a single fitness device that can be used with virtually unlimited accessories to, because of buoyancy of the water, replace many very expensive machines that are necessary to allow the user to apply a force less than gravity currently allows. Also, due to buoyancy the apparatus allows the body to be positioned in the water in ways that are impossible in air. This allows the user to utilize buoyancy to the degree he prefers or is able. Thus, a very heavy user who cannot raise himself with chin-ups can perform chin-ups using the apparatus. And as he gains strength, he can raise the apparatus to reduce the amount that the buoyancy decreases the felt resistance to the chin-ups.

Figure 1:
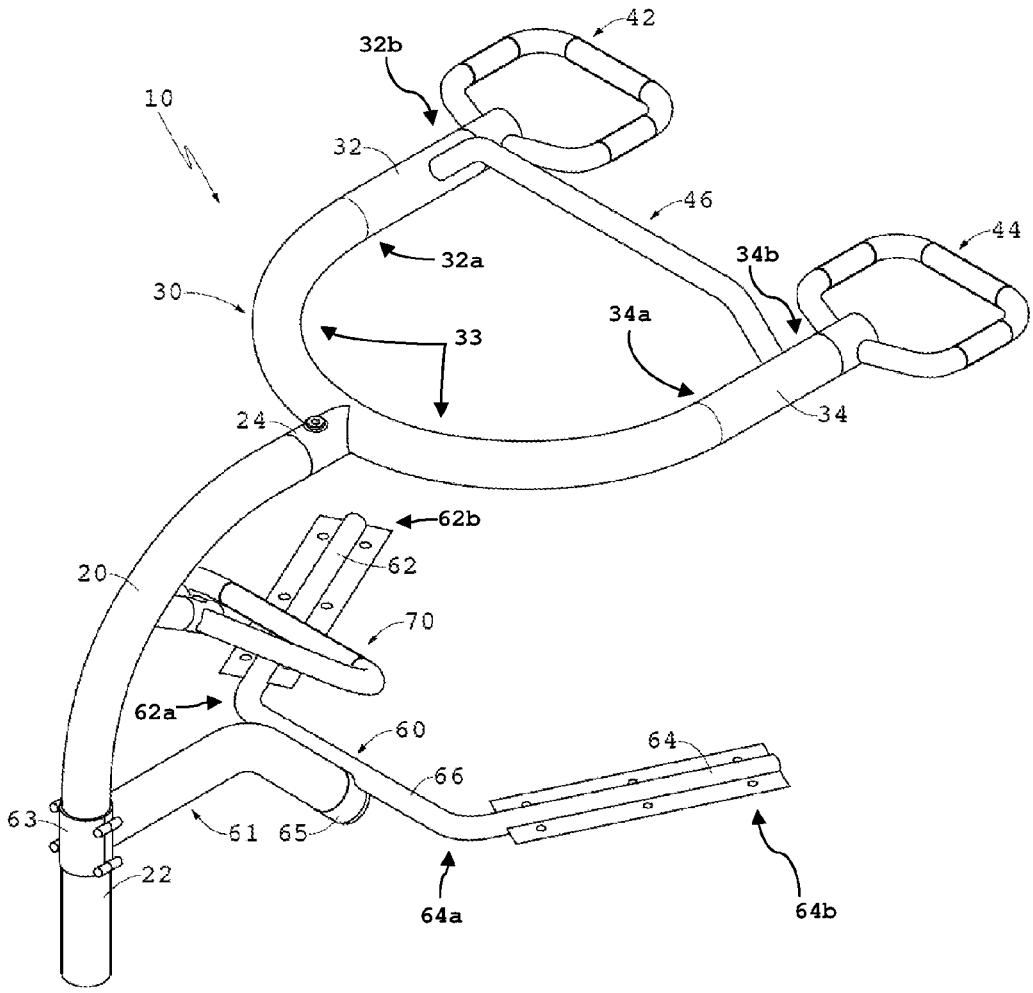
FIG. 1 is a view in perspective illustrating a preferred embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Provisional Application No. 61/818,433 filed May 1, 2013 is incorporated into this application by reference.

Figure 2:
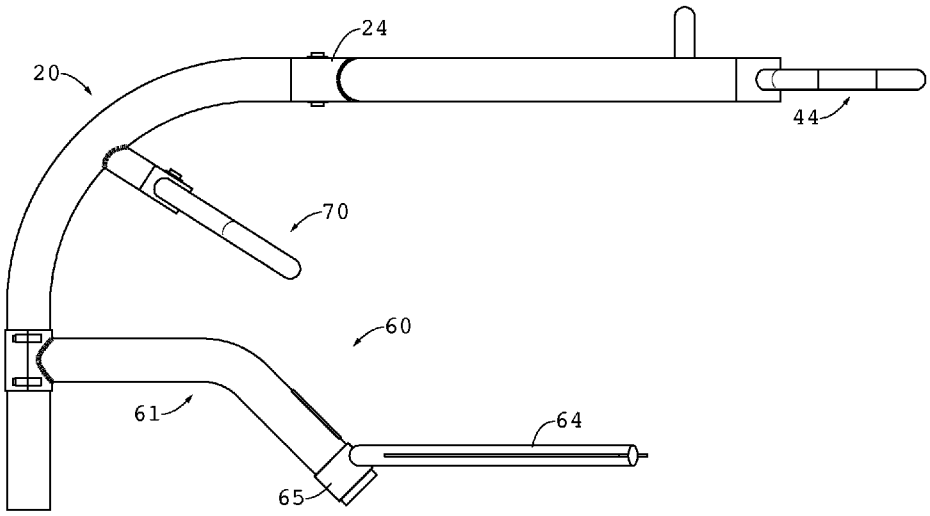
FIG. 2 is a side view illustrating the embodiment of FIG. 1.
Figure 3:
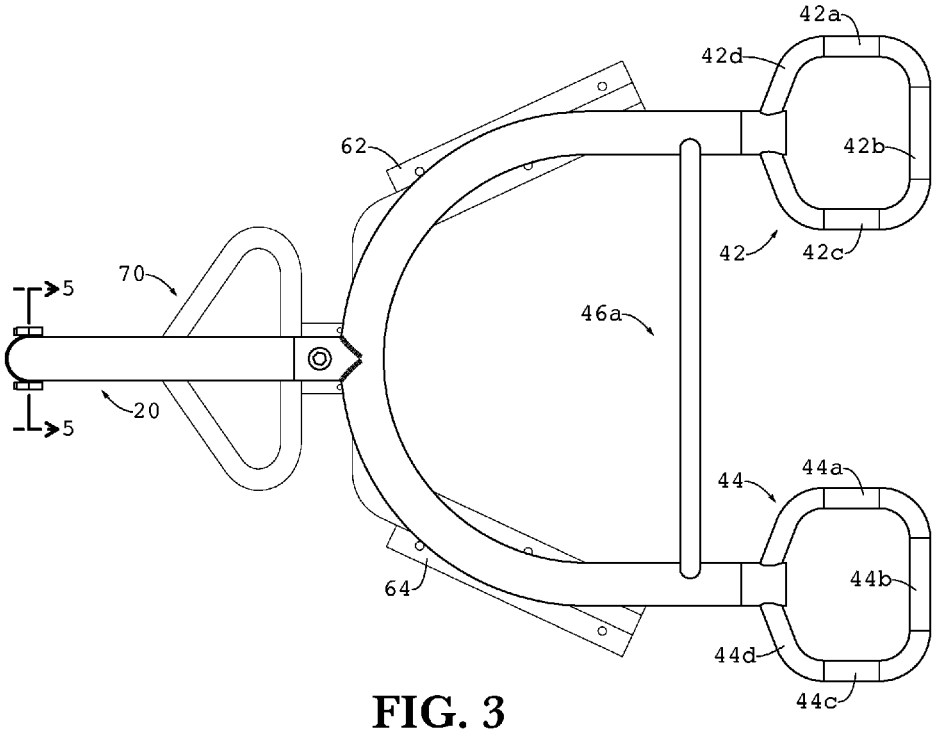
FIG. 3 is a top view illustrating the embodiment of FIG. 1.

The fitness apparatus 10 is shown in FIGS. 1-3 having a central support member, such as the central boom 20, and a furcated support member, such as the U-shaped wishbone 30. The boom 20 provides a central support for the apparatus 10, and enables all components of the apparatus 10 to mount to a stationary object, such as a pool frame, sidewalk, deck or other stable structure adjacent the sidewall of the pool or other container, such as a hot tub or fitness pool. Unless stated otherwise, the boom 20, the wishbone 30, and all other components of the apparatus 10 are made of tubular stainless steel. Of course, aluminum, titanium, fiber-reinforced polymer composites and many other materials can be substituted for stainless steel with corresponding advantages and disadvantages.

Figure 4:
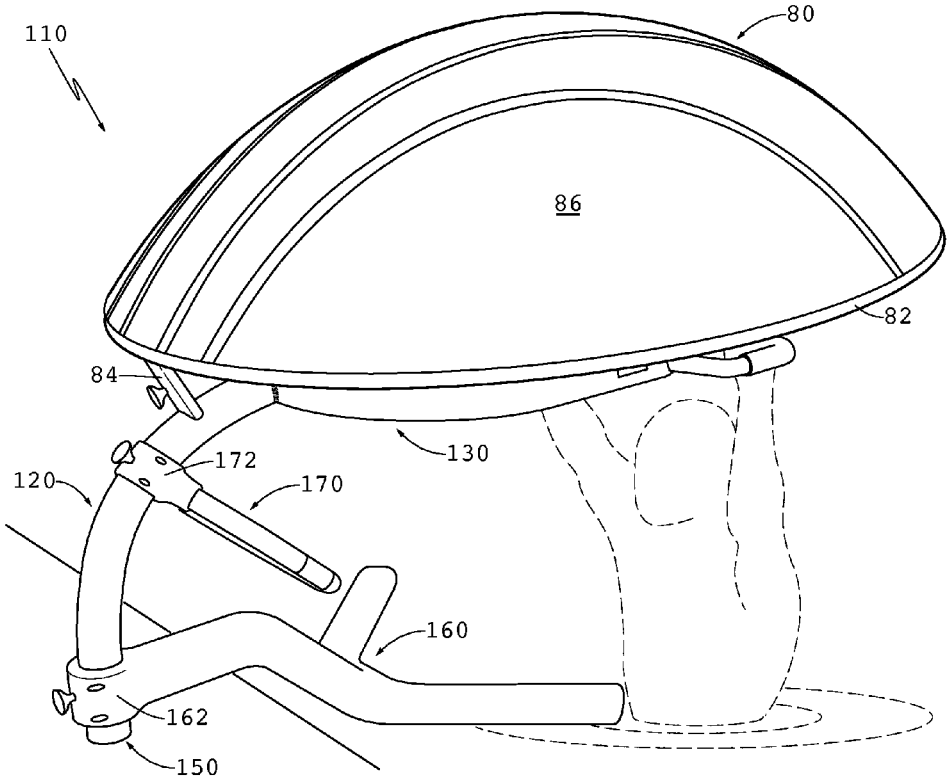
FIG. 4 is a view in perspective illustrating an alternative embodiment in an operable orientation in use by a person.
Figure 5:
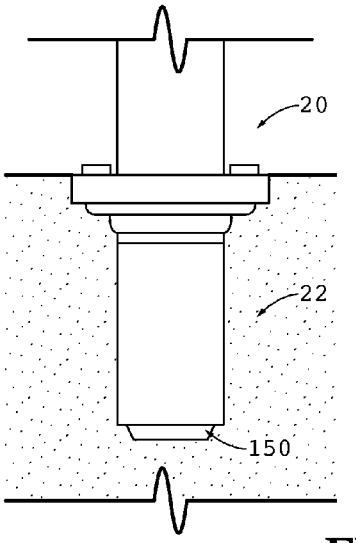
FIG. 5 is a side view in section through the lines 5-5 of FIG. 3.

The boom 20 preferably has a lower end 22 that is straight and extends into an aperture 150 at the side of a swimming pool or other body of water, as shown in FIGS. 4 and 5. A curved section connects the lower end 22 with an upper end 24 that is disposed above the surface of the water, where the wishbone 30 attaches. It is preferred that an angle of approximately ninety degrees is formed in the boom 20 between the lower end 22 and the upper end 24, as best shown in FIG. 2. It is contemplated that the angle can range between about 30 degrees and about 150 degrees. The aperture 150 has an inner diameter that is slightly larger than the outer diameter of the lower end 22, and the lower end 22 slides into the aperture 150 and locks into place. The locking can be accomplished by friction and the force due to gravity, or a separate or integrated fastener or an adhesive can be engaged. Of course, it will be understood by the person of ordinary skill from the disclosure herein that various means for attaching the boom 20 adjacent a body of water can be used. A transverse plate can be attached at the end of the boom 20, and apertures can be formed through the plate through which screws or other fasteners can extend to attach the plate to concrete, wood or other material that can form a walking surface around a pool. In all circumstances contemplated, the boom 20 is mounted at the lower end 22 to a stable structure adjacent the sidewall of the pool or other container, and at least part of the wishbone 30 extends over the water adjacent the boom 20.

The wishbone 30 is preferably defined by two legs, which may be lateral support members 32 and 34 extending from a central connection 33 at first support member ends 32*a* and 34*a* to the upper end 24 of the boom 20. The lateral support members 32 and 34 are spaced from, and preferably substantially parallel to, one another. The spacing between the members 32 and 34 can be about two feet, but the gap can be modified depending upon the size of the user, as with essentially all components of the apparatus 10. The wishbone 30 can be removably mounted to the boom 20, such as by inserting a slightly smaller diameter tube, which extends from the wishbone, into the upper end 24 and then inserting a bolt or other fastener through the overlapping tube walls. More preferably, a spline shaft or equivalent is formed on one of the wishbone 30 and upper end 24, and a matingly receiving spline socket is formed on the other. Alternatively, the wishbone 30 can be welded to the boom 20, or any other conventional fastening means can be used.

At opposite handle ends 32*b* and 34*b* of the support members 32 and 34, respectively, that define the wishbone 30 from the first support member ends 32*a* and 34*a*, hand-grippable handles 42 and 44 are preferably mounted to the tips of the lateral support members 32 and 34, respectively. Each of the handles 42 and 44 is preferably spaced at least about three feet, and more preferably about four to five feet, from the lower end 22 of the boom 20. Thus, when the lower end 22 is mounted near the edge of a pool, the handles 42 and 44 are positioned directly above the water of the pool, and preferably at least one to three feet from the edge of the pool.

The handles 42 and 44 are polygonal, with at least three distinct sides angled to each other. At least two sides are for gripping and one is for attaching to the ends of the support members 42 and 44. The preferred handles 42 and 44 are rectangular, having sides 42*a*, 42*b*, 42*c*, 42*d*, 44*a*, 44*b*, 44*c* and 44*d*, as best illustrated in FIG. 3. All sides of the handles can be grasped by a human user, but the sides 42*a*-42*c* and 44*a*-44*c* are specifically designed for gripping as will be described below in detail. The sides 42*d* and 44*d* are mounted, such as by welding, to the ends of the lateral support members 32 and 34, respectively. It is also contemplated that each of the handles 42 and 44 can be welded to a sleeve that is slightly smaller than the inner diameter of the lateral support members 32 and 34. The sleeves are inserted into the lateral support members 32 and 34 and bolted, splined or otherwise fastened to avoid substantial relative rotation. Other handles can be substituted for the handles 32 and 34, such as triangular handles (not shown).

Figure 6:
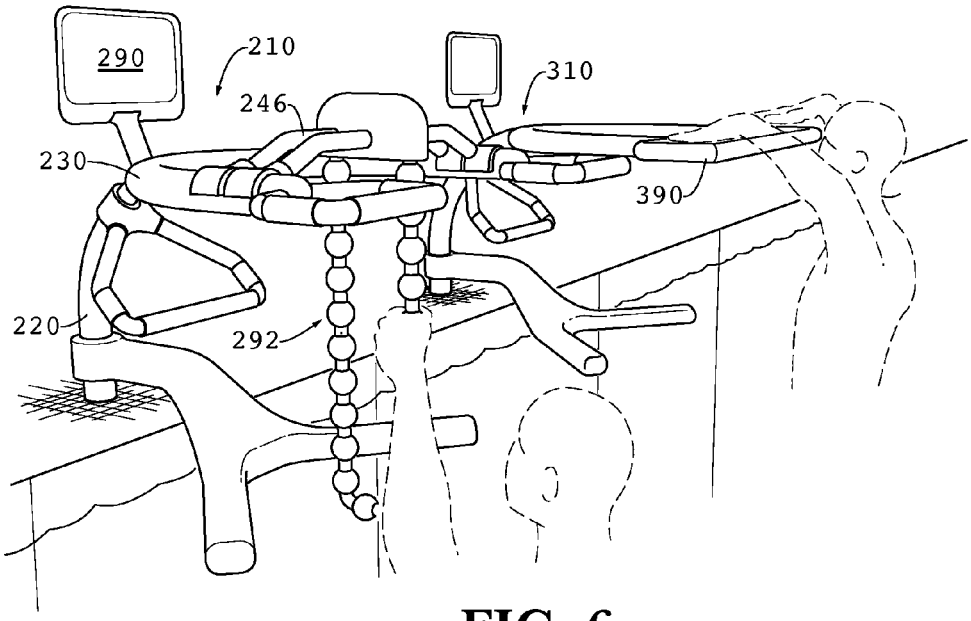
FIG. 6 is a view in perspective illustrating multiple embodiments of the present invention.
Figure 7:
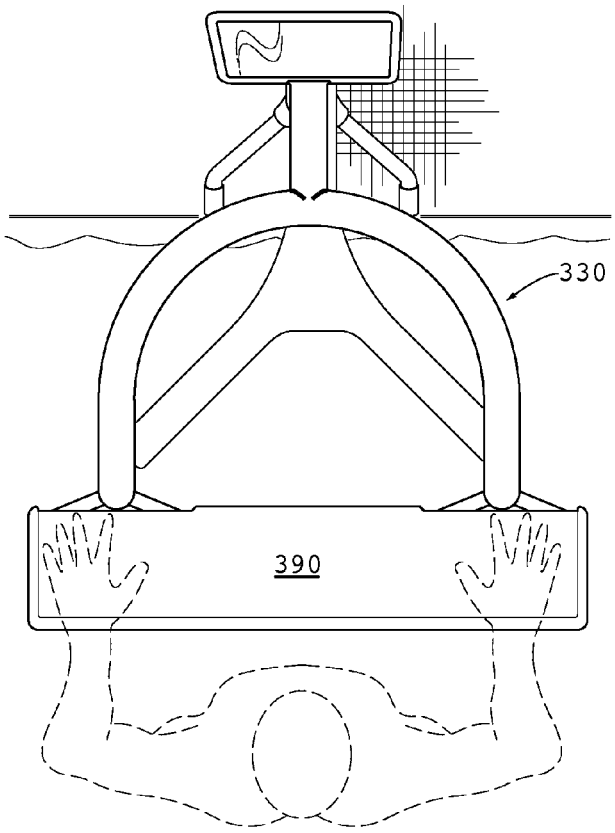
FIG. 7 is a top view illustrating an embodiment of the present invention illustrated in FIG. 6.

The crossbar 46 is mounted transversely, and preferably perpendicularly, to the support members 32 and 34, such as by welding or by clampingly-gripping collars rigidly mounted to the ends of the crossbar 46 and extending around the support members 32 and 34 (see FIG. 6). Any attachment means that permits a person to grasp and hold onto the central region 46*a* (see FIG. 3) of the crossbar 46 is suitable. The crossbar 46 is preferably mounted along the support members 32 and 34 by means that permit hand-movement to a more desirable position, followed by hand-locking of the crossbar 46 in place to resist movement. This allows the user to move the crossbar 46 without the use of tools.

A handle 70, which is preferably triangular or oval, mounts to the boom 20 below the wishbone 30, rigidly by welding, as shown in FIG. 1, or by a collar that extends around the boom and can be tightened and loosened for repositioning (see FIG. 4). The handle 170 in FIG. 4 can be rotated about the longitudinal axis of the boom 120 when the collar 172 is loosened, thereby permitting re-positioning. The collar 172 can be tightened with the handle 170 in position as shown in FIG. 4, or rotated 180 degrees (directed away from the user in the pool) so that a user on the walking surface can stabilize himself out of the water.

A lower support member, which is preferably the Y-shaped member 60, mounts rigidly and preferably adjustably, to the boom 20 below the handle 70. A central support sub-boom 61 attaches to the boom 20 between the upper end 24 and the lower end 22 by an adjustable collar 63 that is rigidly attached, such as by welding, to the end of the central support sub-boom 61. The collar 63 extends around the boom 20 and can be tightened, such as by adjusting a plurality of bolts that decrease the diameter of the collar 63 after positioning the sub-boom 61 where desired.

At the opposite end of the sub-boom 61 from the boom 20, the lateral support members 62 and 64 attach to a support member 66, which mounts to a collar (mounting structure) 65 that permits rotation about a line perpendicular to the axis of the sub-boom 61, preferably along the longitudinal axis of the support member 66. This configuration allows the lateral support members 62 and 64 to pivot upwardly about the axis of the support member 66 at first ends 62*a* and 64*a*, thereby swinging the opposite, second ends 62*b* and 64*b* out of the way of a user disposed beneath the wishbone 30.

The lateral support members 62 and 64 are preferably covered by waterproof pads (not visible), which can be made of rubber, polyurethane or foam. Such pads permit a user to rest his or her hands, arms, forearms, legs or any other body part comfortably against the lateral support members 62 and 64 during use, while placing at least a portion of the weight of his or her body on the lateral support members 62 and 64. Any other surfaces of the apparatus 10 can be covered by protective or friction-enhancing tape or padding to avoid slipping during use.

A person can use the apparatus 10 for various exercises, only a few of which are described herein. A person having ordinary skill will understand from the description how to modify the exercises and how to add exercises not discussed herein. One exercise is pull-ups, which are performed when the user is in the water below the wishbone 30 with his arms held vertically above his body and his hands grasping the handles 42 and 44. The lower support 60 is preferably folded toward the boom 20 (not illustrated). The user preferably grasps the handle sections 42*b* and 44*b* with the palms of his hands facing the same direction as his chest (anterior) or back (posterior). Alternatively, the handle sections 42*a* and 44*c* can be grasped with the palms facing one another to space the hands relatively far from one another. As another alternative, the handle sections 42*c* and 44*a* can be grasped with the palms facing one another and spaced more closely. In any of these positions, the user simply raises himself away from the surface of the water by bending his arms and then straightening them again, thereby performing a conventional pull-up. The user can place her hands around the crossbar 46, with palms facing her posterior or anterior. The user then bends her arms, thereby lifting herself out of the water, and then straightens her arms to lower herself again.

In both types of pull-ups, the user gains the advantage of the buoyancy of water during the exercise. As the user pulls herself out of the water, the amount of assistance provided by buoyancy decreases, thereby increasing the apparent load encountered by the user. The preferred embodiment has a telescoping feature (not visible) that permits vertical adjustability. In one contemplated embodiment, a pneumatic ram or other, equivalent structure, such as are commonly found in the pedestals of office chairs, is mounted along the boom 20 to permit movement of the upper region of the boom relative to the lower region of the boom. Using this structure, a user may wish to raise or lower a portion of the apparatus 10 relative to the surface of the water in order to accommodate the amount of buoyancy needed or desired.

Such use can include performing "dips" on the lateral support members 62 and 64 by placing the hands on the lateral support members 62 and 64. This is accomplished while the trunk is positioned between the lateral support members 62 and 64. The suspended portion of the body is then lowered and then raised by bending and then straightening the arms. The person can face the side of the pool or the opposite direction during this exercise. Alternatively, the person's forearms can be placed on the lateral support members 62 and 64 with the back toward the sub-boom 61 and the legs extending downwardly, and the spine can be alternatingly loaded and unloaded while much of the user's lower body is buoyed by the water. This is an excellent way to gently load and unload the spine, particularly for a person who has a substantial lower body weight.

A pair of straps can be attached to the lateral support members 32 and 34 or the crossbar 46, and the straps can engage the user's forearms or upper arms to assist if hand strength is not sufficient to hold onto the crossbar 46 or handles 42 and 44. The straps preferably slide along the supporting members prior to use, but tighten, such as by a slipknot, to avoid slipping significantly during use.

While the user's body is straight and essentially parallel to the surface of the water, she can lie on her back with the rear of her head and shoulders on the support members 62, 64 and 66. In this position, the hands grasp the support handle 70 that extends from the boom 20. In this position, the user can kick her legs in a simulated swimming movement, or can perform abdominal "crunches" by raising her legs toward her chest and then extending them. This provides substantial leg and abdominal exercise, without the need to move the body across the water.

In the alternative embodiment of FIG. 4, the apparatus 110 has a central boom 120 to which a wishbone 130 is mounted, such as by welding. The handle 170 is mounted to the boom 120 by an expandable, clamping collar 172, and the lower support member 160 is mounted to the boom 120 by an expandable, clamping collar 162. The collars 162 and 172 clamp their respective members to the boom 120 and provide a friction grip to prevent any substantial movement relative to the boom 120 until loosened by hand or with tools. A cover 80 is preferably mounted to the boom 120 for protecting the apparatus 110 from sun, rain or any other damaging elements. The cover preferably has a frame 82 with a fabric, plastic, such as polycarbonate, aluminum or any other lightweight and strong shield 86 that protects the apparatus 110. The frame 82 mounts to the boom 120 by the arm 84 extending between the boom 120 and the frame 82.

In FIG. 6, several alternative embodiments are shown. The apparatus 210 has a crossbar 246 that mounts to both lateral support members of the wishbone 230. An "infinite rope" apparatus 292 is mounted to the central region of the crossbar 246. Such an apparatus 292 permits a user to engage in the exercise of pulling downwardly using one hand on the front span of the "rope", which permits the rope to move around a pulley with predetermined resistance. The user then grasps the portion of the rope that is exposed with the second hand and pulls downwardly, and then repeats the cycle. Virtually any exercise apparatus, which users operate from a suspended position relative to the user, can be attached to the apparatus 210. A screen 290 is mounted to the boom 220, and permits a user to write or otherwise attach indicia, including alphanumeric characters, illustrations or any other communication tools, to the screen 290.

The apparatus 310 has a plate 390 mounted to the wishbone 330 to permit the user to perform fingertip pull-ups. The plate 390 rests upon, and preferably attaches to, the lateral support members of the wishbone 330. The plate 390 can also be used in association with a spaced crossbar (not shown) so that a user can rest the back of her calves on the top of the plate 390, place her shins against the underside of the crossbar and hang her torso upside down from the wishbone 330. This permits the user to perform "crunches" in which the user contracts her abdominal muscles to bend her midsection, thereby raising her torso up, and then relaxing to allow the torso to be lowered under the force of gravity. This can be repeated cyclically.

Although only one central boom is shown attaching to the sidewalk or other structure adjacent the water container sidewall, it is contemplated to use more than one boom, particularly if additional strength is needed.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A fitness device for attaching adjacent a water container and use by a human when the human is at least partially submerged in water in the container, the fitness device comprising:

(a) a central boom having a first boom end configured for rigidly mounting adjacent the water container and the central boom extending to a second boom end;

(b) a sub-boom mounted to the central boom;

(c) a U-shaped member rigidly mounted to the central boom's second end and contained within a plane oriented at substantially a right angle to the first boom end, the U-shaped member defined by first and second upper lateral support members extending from a central connection mounted to the central boom near the second boom end, the first and second upper lateral support members having handle ends, and are substantially parallel and spaced apart about two feet;

(d) first and second hand-grippable handles mounted to the handle ends of the first and second upper lateral support members and configured to be mounted above the water when the first boom end is mounted adjacent the water container; and (e) a lower support member extending from the central boom, the lower support member having first and second lower lateral support members spaced from the U-shaped member and extending from the first and second lower lateral support members' first ends, which are mounted to an end of the sub-boom that is spaced from the central boom, to the first and second lower lateral support members' second ends, which are spaced from the sub-boom, with a mounting structure that permits pivoting of the first and second lower lateral support members relative to the sub-boom, whereby the first and second lower lateral support members are adapted to pivot toward the central boom.

2. The fitness device in accordance with claim 1, further comprising a handle mounted to the central boom and disposed between the U-shaped member and the lower support member.

3. The fitness device in accordance with claim 1, further comprising a shield disposed adjacent the U-shaped member and mounted to at least the central boom.

4. The fitness device in accordance with claim 1, wherein each of the first and second hand-grippable handles is substantially rectangular with hand-grippable surfaces angled to one another.

5. The fitness device in accordance with claim 1, wherein each of the first and second hand-grippable handles substantially triangular with hand-grippable surfaces angled to one another.

6. The fitness device in accordance with claim 1, further comprising a shield is disposed above the U-shaped member and mounted to the fitness device.

7. An exercise apparatus in combination with a container having a sidewall retaining water, the combination comprising:

(a) a central boom having a lower boom end rigidly mounted adjacent the sidewall and the central boom extending in a substantially vertical orientation to an upper boom end that is closer to being above the water, and is higher, than the lower boom end;

(b) a sub-boom mounted to the central boom;

(c) a U-shaped member rigidly mounted to the central boom at the upper boom end, with and contained within a plane oriented substantially horizontally, the U-shaped member defined by first and second upper lateral support members extending from a central connection mounted to the central boom near the second boom end, the first and second upper lateral support members having handle ends, and are substantially parallel and spaced apart about two feet;

(d) first and second hand-grippable handles mounted to the handle ends directly above the water to permit a body of a person grasping the handles to extend vertically downwardly into the water;

(e) a lower support member extending from the central boom, the lower support member having first and second lower lateral support members disposed below the U-shaped member and extending from the first and second lower lateral support members' first ends, which are mounted to an end of the sub-boom farthest from the central boom, to the first and second lower lateral support members' second ends, which are spaced from the sub-boom, with a mounting structure that permits pivoting of the first and second lower lateral support members relative to the sub-boom, whereby the first and second lower lateral support members are adapted to pivot away from beneath the U-shaped member.

8. The combination in accordance with claim 7, wherein the lower boom end attaches to a surface adjacent the container sidewall.

9. The combination in accordance with claim 8, wherein the surface adjacent the container sidewall is a walking surface.

10. The combination in accordance with claim 7, further comprising a handle mounted to the central boom and disposed between the U-shaped member and the lower support member.

11. The combination in accordance with claim 7, further comprising a shield disposed above the U-shaped member and mounted to at least the central boom.

12. The combination in accordance with claim 7, wherein each of the first and second hand-grippable handles is substantially rectangular with hand-grippable surfaces angled to one another.

13. The combination in accordance with claim 7, wherein each of the first and second hand-grippable handles is substantially triangular with hand-grippable surfaces angled to one another.

14. The combination in accordance with claim 7, further comprising a shield disposed above the U-shaped member and mounted to the exercise apparatus.

* * * * *